US008348606B2

(12) United States Patent
Gopalan et al.

(10) Patent No.: US 8,348,606 B2
(45) Date of Patent: Jan. 8, 2013

(54) WASHER PUMP

(75) Inventors: Shridhar Gopalan, Westminster, MD (US); Alan Romack, Columbia, MD (US); Chunling Zhao, Laurel, MD (US)

(73) Assignee: Bowles Fluidics Corp., Columbia, MD (US)

( * ) Notice: Subject to any disclaimer, the term of this patent is extended or adjusted under 35 U.S.C. 154(b) by 599 days.

(21) Appl. No.: 12/481,357

(22) Filed: Jun. 9, 2009

(65) Prior Publication Data

US 2009/0324434 A1 Dec. 31, 2009

Related U.S. Application Data

(60) Provisional application No. 61/060,112, filed on Jun. 9, 2008.

(51) Int. Cl.
*F04D 29/00* (2006.01)

(52) U.S. Cl. ..... 415/206; 416/175; 416/198 R; 416/243; 417/423.3; 417/423.9; 417/423.12; 417/423.14; 417/424.1

(58) Field of Classification Search ..... 415/206; 416/175, 198 R, 243; 417/423.3, 423.9, 417/423.12, 423.14, 424.1
See application file for complete search history.

(56) References Cited

U.S. PATENT DOCUMENTS 5,074,764 A * 12/1991 Kobayashi et al. ..... 417/423.3
6,015,276 A * 1/2000 Ponziani ..... 416/179

* cited by examiner

*Primary Examiner* — Igor Kershteyn
(74) *Attorney, Agent, or Firm* — J. Andrew McKinney, Jr.

(57) ABSTRACT

An enhanced pump assembly includes an impeller and volute casing designed to provide high operating pressures ("P") and flow rates ("Q") with low energy usage. The impeller has a central shaft carrying radially projecting curved primary vanes, and each primary vane also has a twist in the radial direction. Secondary impeller vanes define triangular connecting fillet-like wall segments connecting each primary vane to the impeller shaft. The casing of the pump has a slight spiral deviation so that the pump chamber's radial sidewall flares away from the swept area of the impeller's vanes to define a fluid outlet that contributes to higher P-Q performance, especially when pumping colder fluids.

17 Claims, 8 Drawing Sheets

Section A-A

Detail B

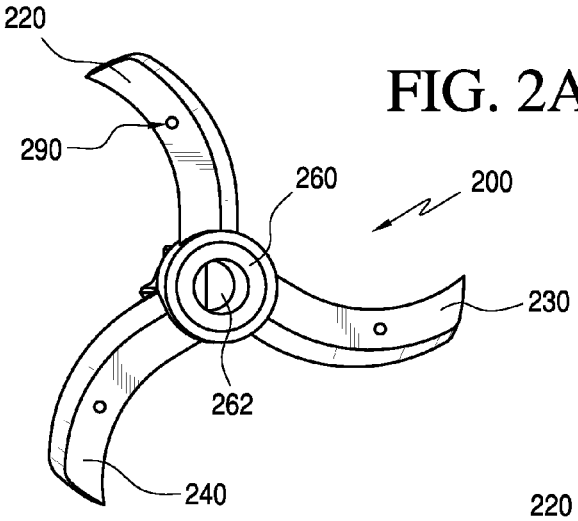
FIG. 2A
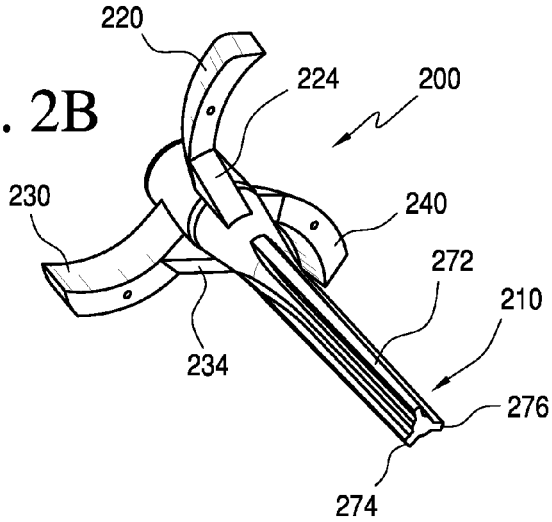
FIG. 2B
FIG. 2C
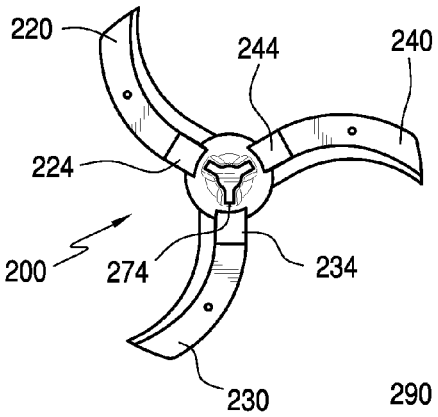
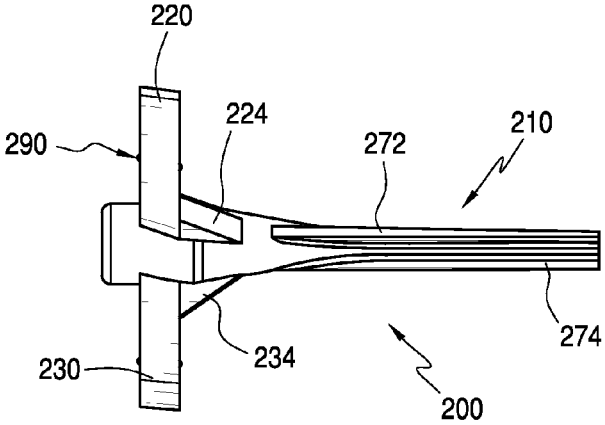
FIG. 2D

WASHER PUMP

This application claims priority benefit to commonly owned patent application No. 61/060,112 filed on Jun. 9, 2008, the entire disclosure of which is incorporated herein by reference.

BACKGROUND OF THE INVENTION

1. Field of the Invention

The present invention relates to pumps configured to spray washer fluid onto an automotive windshield, headlamp or other surface, to assist a cleaning or wiping operation.

2. Discussion of Related Art

Automotive windshield washer systems now in use in automotive vehicles generally include at least one windshield wiper adapted to be driven by a drive unit to move back and forth across the windshield, a windshield washer pump having an inlet and an outlet, at least one jetting nozzle generally carried on the automobile's hood and fluid-connected with the outlet of the washer pump for spraying a cleaning fluid onto the windshield, and a container or tank for accommodating a quantity of the cleaning or washing fluid and fluid-connected with the inlet of the washer pump.

U.S. Pat. No. 5,184,946 discloses a typical windshield washing system in, for example, that patent's FIG. 1, wherein the windshield washer system comprises a rinsing fluid tank of a generally box-like configuration including four side walls, a bottom wall and a top wall. The top wall of the rinsing fluid tank has a capped supply port defined therein, and one of the side walls has a pump mounting hole defined therein adjacent the bottom wall. A resilient sealing grommet having an annular fitting flange is mounted in the pump mounting hole with the annular flange fluid-tightly welded to the side wall. An automotive washer pump assembly has a generally cylindrical configuration and is pressure-fitted into the tubular grommet so that the pump's inlet is in fluid communication with the fluid contents of the fluid tank. The washer pump assembly is used to supply the washing fluid within the tank by pumping the fluid to at least one spray nozzle through a tubing to spray the washing fluid onto a windshield thereby to assist a wiping operation performed by a windshield wiper. As is well known, the jetting nozzle is generally disposed on a bonnet or hood in an automotive body structure and is aimed at the windshield. Other patents on similar systems in this field include U.S. Pat. No. 5,181,838 and U.S. Pat. No. 6,053,708, and all three of these patents are incorporated herein, for purposes of nomenclature and to illustrate the background of the automotive windshield washing art.

The automotive washer pumps used are typically of a centrifugal type wherein the fluid medium is supplied by the action of a centrifugal force. A centrifugal pump is a rotodynamic pump that uses a rotating impeller to increase the pressure of a fluid. Centrifugal pumps are commonly used to move liquids through a tubing or piping system. The fluid enters the pump impeller along or near to the rotating axis and is accelerated by the impeller, flowing radially outward into a diffuser or volute chamber (or casing), from where it exits into the downstream piping system. Centrifugal pumps are typically used for large discharge through smaller heads. An impeller is a rotating component of a centrifugal pump, usually made of plastic, steel, bronze, brass or aluminum, which transfers energy from the motor that drives the pump to the fluid being pumped by accelerating the fluid outwards from the center of rotation. The velocity achieved by the impeller develops increased fluid pressure within the pump's volute when the outward movement of the fluid is confined by the pump casing. Put another way, the impeller's purpose is to convert energy of an electric motor into velocity or kinetic energy and then into pressure of a fluid that is being pumped. The energy changes occur into two main parts of the pump, the impeller and the volute. The impeller is the rotating part that converts driver energy into the kinetic energy. The volute is the stationary part that converts the kinetic energy into pressure. Impellers are often configured as short cylinders with an open inlet (called an eye) to accept incoming fluid, vanes to push the fluid radially, and a splined, keyed or threaded bore to accept a driveshaft. Typical automotive washer pump assemblies use plastic impellers and cylindrical volute casings and so are economical to manufacture, but are limited in that they have problems working with colder fluid, which can be significantly more viscous that typical washing fluid at normal room temperatures.

Variations in fluid pressure can have an adverse effect on windshield cleaning, especially in some modern systems, which typically employ fluidic circuits in the nozzle assemblies used to aim spray at the windshield or headlamp. Modern systems sometimes require high operating pressures and flow rates, for example, when the automobile is in motion, the passing air tends to depress the spray, thus it is necessary to have high nozzle operating pressures if the cleaning fluid is to be sprayed in a satisfactory pattern. Similarly, efficacy of headlamp cleaning depends on the nozzle pressure, thus calling for a pump with a higher performance Pressure-flow rate (P-Q) characteristic. In cold weather, as noted above, the washer fluid viscosity increases and pump pressures are typically reduced. As a result, the nozzles operate at lower pressure in cold weather, leading to reduced windshield cleaning performance in cold weather. The performance of a washer pump in cold weather is referred to as "cold performance" and it is very desirable to improve this aspect of a washer pump's operation, i.e. a better pump P-Q curve at higher viscosities. Washer fluids or liquids used at such temperatures include alcohol mixtures with water having low freezing points. Thus, the viscosity of the liquid is high (e.g. 25 centipoise ("cP"), where water viscosity at Room Temperature ("RT") is ~1 cP).

The prior art washer pumps included are not satisfactory for many applications, such as windshield or headlamp cleaning with a mixture of 50-50 ethanol-water at −4 F, and those washer pumps typically provide only marginally satisfactory Pressure-Flow Rate (P-Q) performance.

It is with these and other considerations being kept in mind that the designs of the embodiments of the present invention were created.

SUMMARY OF THE INVENTION

In accordance with the present invention, an enhanced washer pump includes a new impeller geometry with new features. The washer pump assembly of the present invention also includes a new volute casing designed to work with the new impeller to develop high operating pressures and flow rates with low motor current usage. The pump assembly of the present invention is likely to be typically used in automotive applications—spraying fluid on the windshield or for headlamp cleaning.

As noted above, when the automobile is in motion, the passing air tends to depress the spray, and so the inventors recognized that higher nozzle operating pressures were needed. Also, for the windshield washing systems using high-performance fluidic nozzle assemblies, it was observed that efficacy of headlamp cleaning depended on the nozzle pressure, thus calling for a pump with an improved Pressure-flow rate (P-Q) curve, as compared to the prior art. Also, as noted above, in cold weather, the washer fluid viscosity increases and pump pressures reduce. With reduced pump pressure, it was observed that nozzles operated at lower pressure in cold weather, leading to less effective spray onto the headlamp or windshield and reduced cleaning action for the washing system. It was, therefore, a priority to improve this aspect of the pump, i.e. a better pump P-Q curve at higher viscosities (up to 25 cP).

The washer pump assembly of the present invention provides excellent P-O performance at normal operating temperatures and considerably better P-Q performance in the cold, when compared to typical or prior art washer pumps. The enhanced P-Q performance and other improvements are the result of a newly developed impeller and casing, which together form the impeller—casing assembly.

The impeller has a central shaft with a plurality of radially projecting transverse vanes. Each impeller vane is arc-shaped or curved 59 degree at the tip (as compared to a radial line). Each vane also has a 20 deg twist along the vane's axial direction, and these vanes are called the primary vanes. In addition, each primary vane on the impeller is connected to a triangular wall segment or fillet-shaped vane segment that is also connected along the impeller shaft's sidewall. Each vane's fillet-shaped vane segment is connected to the underside of the primary vane to define a secondary vane. The secondary vanes define outer sidewalls that are inclined at 34 deg to the impeller's central shaft axis and are 3.8 mm high. The secondary vanes have a twist angle similar to the primary vanes ranging from 0 to 20 degrees. In the exemplary embodiment, the diameter of the impeller is 21.75 mm and the width of the primary vanes is 2.5 mm. The radial or diametral clearance between the impeller and the pump assemblies casing is 1.25 mm. The total top-bottom clearance between the impeller and the casing is 0.3 mm. The total length of the impeller's central shaft is 30.75 mm.

The casing of the pump has a slight spiral deviation from the basic circular style that most existing automotive centrifugal pump casings have. The impeller of the present invention, when combined with the present invention's spiral-shaped casing contributes to enhanced P-Q performance, especially for cold performance. When seen in plan view, the present invention's casing has a circular profile for most of a circle (e.g., approx. 260 degrees, providing constant clearance with the impeller) and then has a gradually radial sidewall diameter for increasing impeller clearance all the way to the pump's fluid outlet or exit, where the casing's radial sidewall radius is 1.6 times the radius of the segment having the circular profile.

In view of present invention's potential to be the basis for better pumps, the inventors have measured and benchmarked many leading brands and pumps and identified their performance characteristics. An extensive facility for testing and developing new pumps permitted development of many prototypes and assemblies. The P-Q curves of the pump or the present invention was compared to an existing high performance pump (by VDO™), and room temperature performance was evaluated along with cold performance, and significant improvements in cold performance were observed over the VDO pump. At room temperature this invention yields a 1.5 PSI performance advantage. In ethanol water mixtures at −4 F (25 cP), this invention outperforms the prior art washer pumps by 6-8 PSI. All of these pressure advantages are accomplished with less current [energy] consumption. This indicates the higher efficiency of this pump assembly.

The pump assembly of the present invention can be configured in a variety of ways, including an exemplary embodiment having a bottom inlet configuration. The impeller is 30.75 mm long.

There are two additional exemplary embodiments for the pump assembly of the present invention, each having a side inlet. In a side-inlet top-feed configuration, the impeller is basically the same as the bottom-inlet configuration, but has a much shorter central shaft length and has the motor shaft slot on the opposite side. The casing geometry is basically the same as the bottom-inlet configuration.

A side-inlet bottom-feed pump assembly, the impeller is basically the same as the bottom-inlet configuration, but has a much shorter central shaft length. The total length of the impeller for this embodiment is 13.5 mm. This length relative to the straight portion of the feed is important for performance. The casing geometry is basically the same as the bottom-inlet configuration.

Generally speaking, the pump assembly of the present invention has a few characteristics that are common to all of the exemplary configurations. The enhanced pump assembly includes an impeller and volute casing designed to provide high operating pressures ("P") and flow rates ("Q") with low energy usage. The impeller has a central shaft carrying radially projecting curved primary vanes, and each primary vane also has a twist in the radial direction. Secondary impeller vanes define triangular connecting fillet-like wall segments connecting each primary vane to the impeller shaft. The secondary vanes can also have a twist angle similar to the primary vanes. The casing of the pump has a slight spiral deviation so that the pump chamber's radial sidewall flares away from the swept area of the impeller's vanes to define a fluid outlet that contributes to higher P-Q performance, especially when pumping colder fluids. The casing has a circular profile for approx. 260 deg (providing constant clearance with impeller) and then, approaching the outlet, transitions to a gradually increasing clearance all the way to the exit, where the casing radius is 1.6 times the radius of the casing sidewall's circular profile.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 2A is perspective view of the impeller for the improved pump assembly of FIG. 4A and illustrates the proximal end of the impeller including the motor shaft receiving coupling, in accordance with the present invention.

FIG. 2B is another perspective view of the impeller of FIG. 2A and illustrates the impeller's three primary vanes, each connected with a secondary vane, and illustrating the distally projecting impeller shaft sidewall's first, second and third radially projecting, axially aligned impeller shaft sidewall segments, in accordance with the present invention.

FIG. 2C is another perspective view of the impeller of FIGS. 2A and 2B and illustrates the distal end of the impeller shaft including the distal ends of the impeller shaft's first, second and third radially projecting, axially aligned impeller shaft sidewall segments, in accordance with the present invention.

FIG. 2D is another perspective view of the impeller of FIGS. 2A-2C and illustrates two of the impeller's primary vanes, each connected with a secondary vane, and also illustrates two of the distally projecting impeller shaft sidewall's radially projecting, axially aligned impeller shaft sidewall segments, in accordance with the present invention.

DESCRIPTION OF THE PREFERRED EMBODIMENTS

Figure 1A:
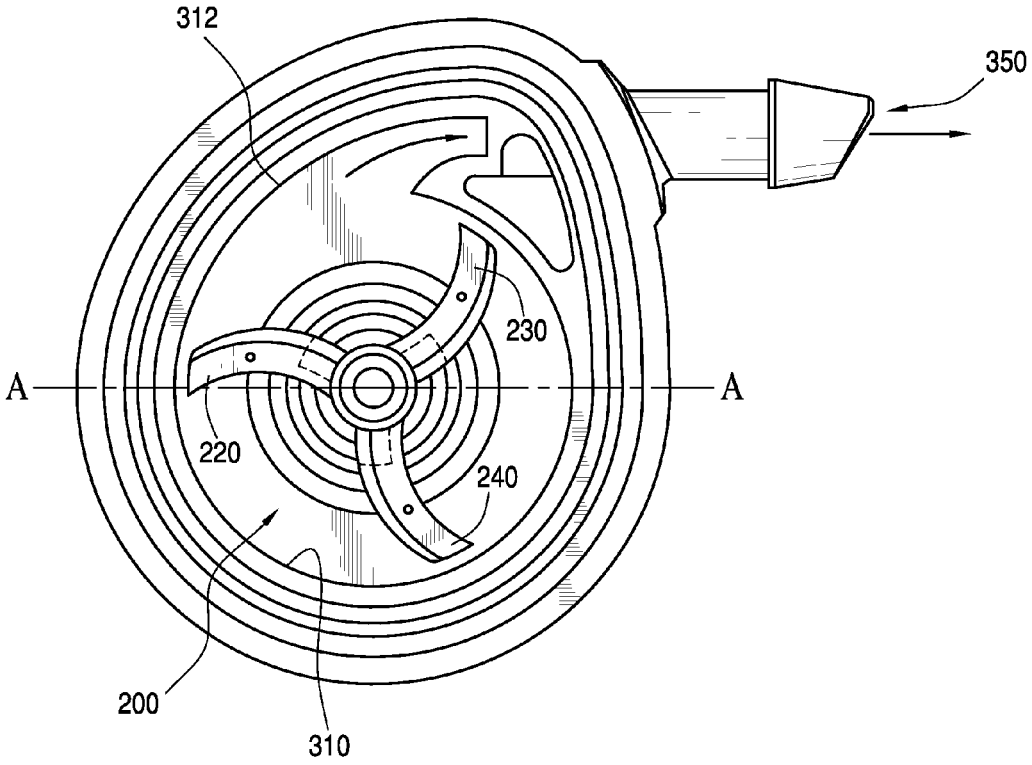
FIG. 1A is plan view of the impeller and volute for the improved pump assembly of FIG. 4A, in accordance with the present invention.

Referring to FIGS. 1A-3B, a first embodiment of the pump assembly 100 of the present invention includes an impeller 200 and volute casing 300 designed to provide high operating pressures ("P") and flow rates ("Q") with low energy usage. Impeller 200, as best seen in FIGS. 2A-2D has a central shaft 210 carrying a plurality (preferably three) radially projecting curved primary vanes 220, 230 and 240, and each primary vane also has a twist along its length (in the radial direction). Secondary impeller vanes 224, 234, and 244 each define triangular connecting fillet-like wall segments connecting each primary vane to the sidewall surface of impeller shaft 210. The secondary vanes can also have a twist similar to the primary vanes. As best seen in FIGS. 1A and 3A, volute 300 has a slight spiral deviation so that the pump chamber's interior sidewall 310 flares away from the swept area of the impeller's primary vanes 220, 230 and 240 to define a fluid outlet 350 that contributes to higher P-Q performance, especially when pumping colder fluids. As best seen in the plan view of the interior shown in FIG. 1A, volute 300 has a peripheral interior sidewall 310 which defines a substantially circular profile for most of the sidewall's extent (approx. 260 deg) and that circular volute sidewall profile provides a substantially constant clearance with distal tips of the impeller's primary vanes. Then, beginning at transition point 312 approaching the fluid outlet 350, the volute's interior sidewall transitions to a sidewall segment having a gradually increasing radial clearance all the way to the exit or fluid outlet 350, where the casing's interior sidewall radius is 1.6 times the radius of the circular profile portion of the interior sidewall.

Figure 1B:
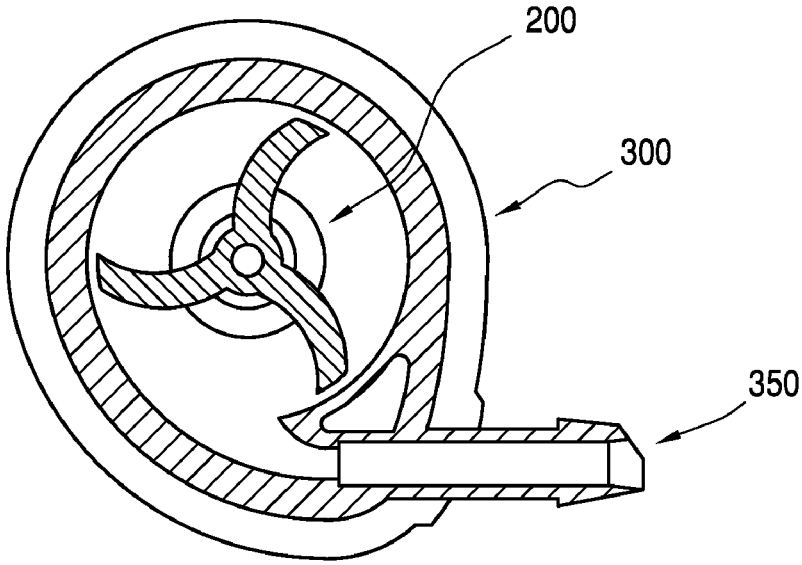
FIG. 1B is a partial cross-sectional view of an impeller and volute, in accordance with the present invention.
Figure 1C:
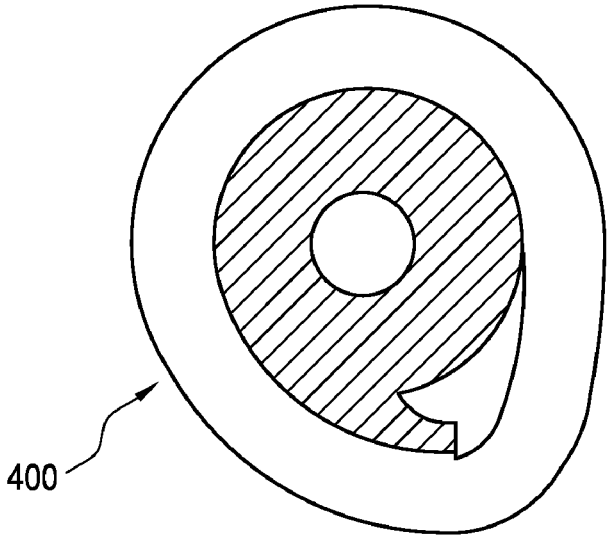
FIG. 1C is a partial cross-sectional view of the bottom of the casing which seals with the volute to define the chamber containing the impeller, in accordance with the present invention.
Figure 1D:
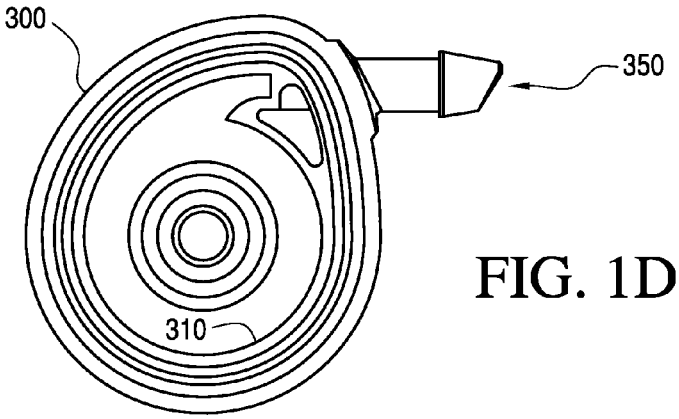
FIG. 1D is plan view of the volute for the improved pump assembly of FIG. 4*a*, in accordance with the present invention.
Figure 1E:
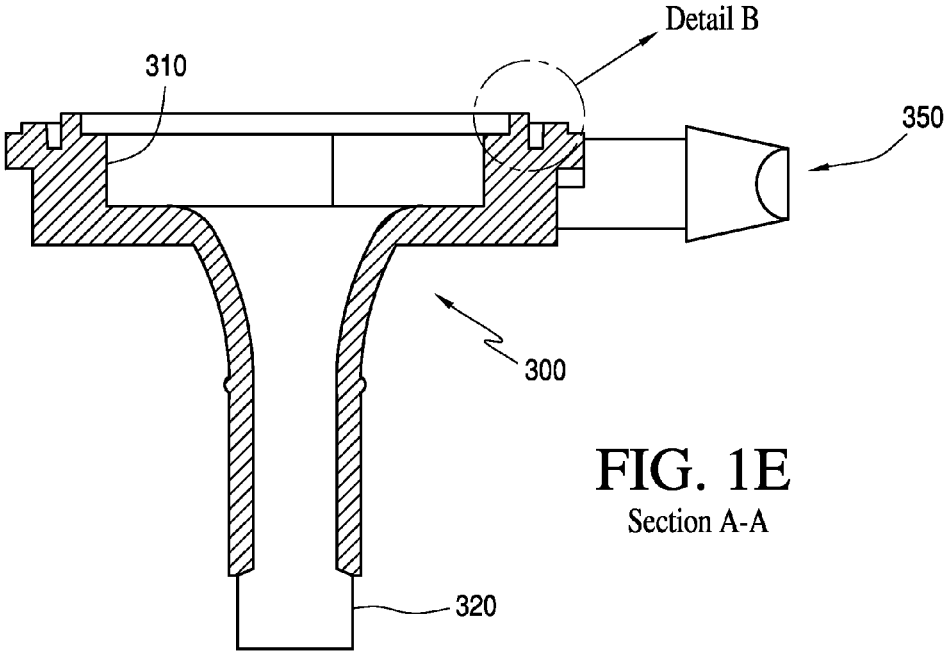
FIG. 1E is a cross section, in elevation, taken along plane A-A, for the volute of FIGS. 1A and 1D, in accordance with the present invention.

As best seen in the views of FIGS. 1B and 1C, volute 300 and the bottom of casing 400 sealably engage one another, so that a fluid-impermeable bottom wall segment defining the bottom of casing 400 to define a pump chamber within which impeller 200 spins, to draw fluid into inlet 320, whereupon the fluid is driven by impeller vanes 22, 230 and 240, pressure is increased, and the fluid is expelled from the pump chamber, flowing into and through pump fluid outlet 350. FIG. 1D is another plan view of volute 300 and FIG. 1E is a cross section, in elevation, taken along plane A-A which projects into the image of FIG. 1A, showing the pump chamber's interior sidewall 310, inlet 320 and outlet 350. As best seen in FIG. 1E, volute 300 has a centrally aligned inlet tube or lumen 320 which is substantially tubular at the tube's bottom or distal end and which increases gradually in an increasing radius at the proximal connection with the pump chamber interior defined therein. Volute 300 has a substantially planar floor region which terminates in the transversely or upwardly projecting interior sidewall 310. Volute inlet 320 is dimensioned to receive impeller 200 and the impeller's elongated shaft passes completely into the lumen of inlet 320, where impeller shaft 210 has a central axis which is also the axis of rotation for impeller 200 when operating within the pump chamber.

Figure 1F:
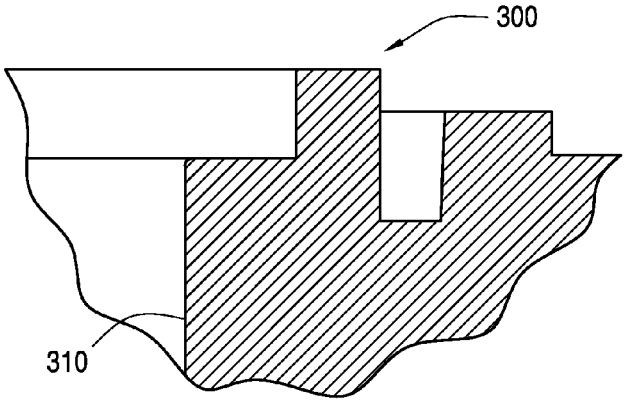
FIG. 1F is a detailed cross section, in elevation, for the troughed sealing surfaces of the volute of FIG. 1E illustrating the features configured to sealable engage with the complimentary ridges and troughs defined in the bottom of the casing as shown in partial section in FIG. 4A, in accordance with the present invention.
Figure 3A:
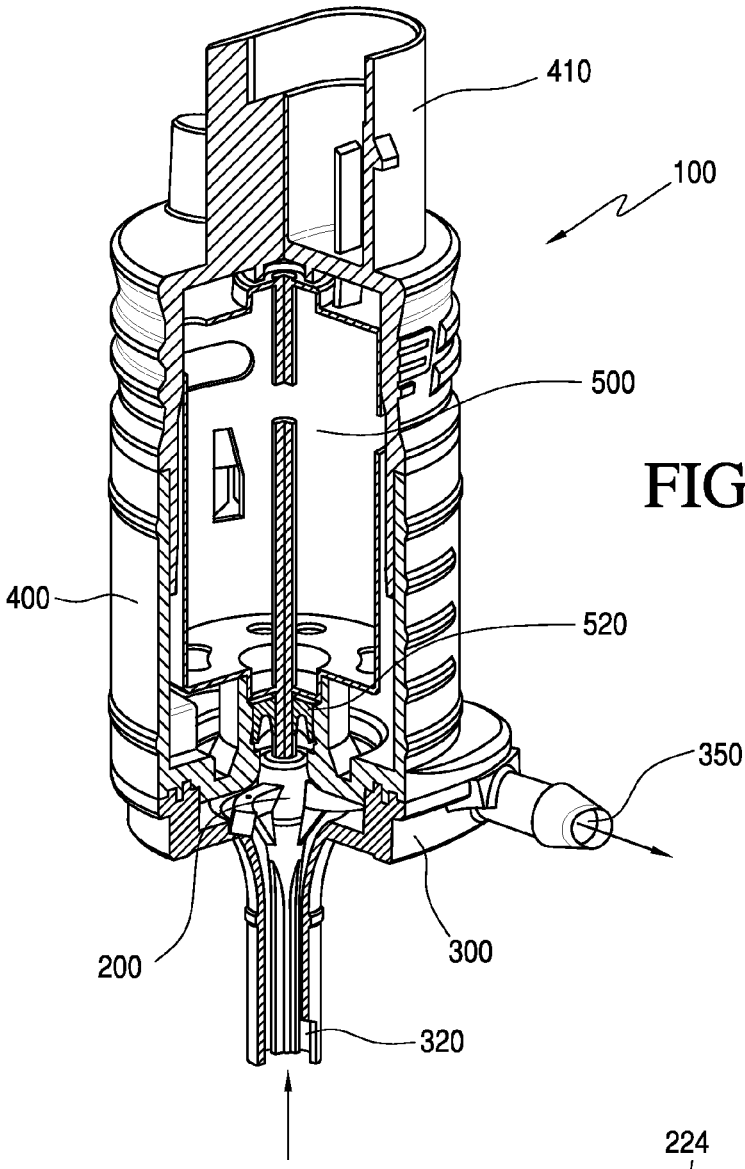
FIG. 3A is perspective view, in elevation and partial cross section, for a bottom inlet embodiment of the improved pump assembly of the present invention.
Figure 3B:
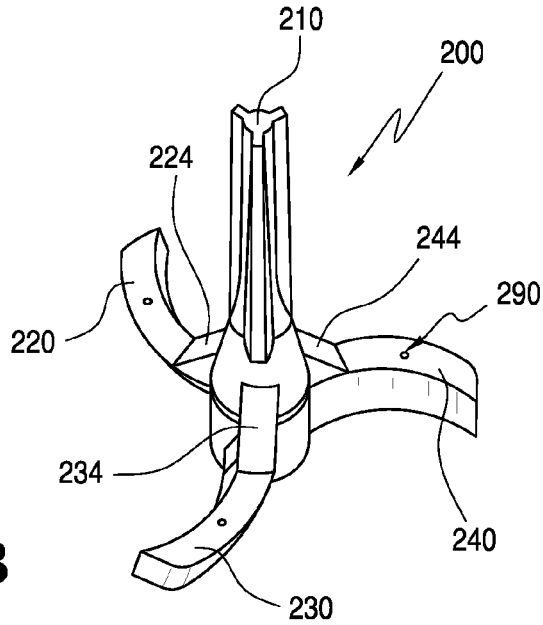
FIG. 3B is a perspective view of the impeller configured for use with the pump assembly embodiment of FIG. 3A.

FIG. 1F is a detailed cross section, in elevation, for the troughed sealing surfaces of volute 300 the features configured to sealably engage with the complimentary ridges and troughs defined in the bottom wall of casing 400, as shown in partial section in FIG. 3A.

Returning to the plan view of FIG. 1A, sidewall 310 has a relatively constant internal radius for most of its length, but, beginning at transition point 312, begins to enlarge in what may be characterized as a spiral or an Archimedes spiral, where:

$$X=\text{constant}*t*\cos(t),$$

where t is in radians and measured from the spiral start, and $$Y=\text{constant}*t*\sin(t)$$

such that, in the applicant's Volute coordinate system:

$$X=(9.5+0.37(t)\cos(t)-6$$

and $$Y=(9.5+0.37t)\sin(t)-4.5$$

and where the rate of expansion, R=0.37*t, such that, in the illustrated embodiment, the start of the spiral arc, is tangent to sidewall transition point 312 (clockwise about 25 degrees from line A-A), while the end of the spiral arc is fixed to be tangent with the outermost wall of the lumen for outlet 350

(about 111 degrees from line A-A), which is 15.6 mm from the center of the volute's iniet's central axis.

FIGS. 2A-2D and 3B illustrate impeller 200 as configured for use in pump assembly 100 of FIG. 3A. Impeller 200 has an upper or proximal end 260 with a drive motor shaft receiving coupling aperture 262. Impeller 200 carries a first transversely projecting curved, twisted primary vane 220, which is connected with a secondary vane 224 that is configured to define triangular connecting fillet-like wall segment connected to primary vane 220 at its root and to the sidewall surface of impeller shaft 210. Note that the secondary vanes can also be twisted similar to the primary vanes.

Impeller 200 carries a second transversely projecting curved, twisted primary vane 230, and second primary vane 230 is radially spaced 120 degrees from first vane 220. Second primary vane is connected with a secondary vane 234 that is configured to define triangular connecting fillet-like wall segment connected to primary vane 230 at its root and to the sidewall surface of impeller shaft 210.

Impeller 200 also carries a third transversely projecting curved, twisted primary vane 240, and third primary vane 230 is radially spaced 120 degrees from both first vane 220 and second vane 230, so that three radially equi-angled vanes are carried by shaft 210. Third primary vane is connected with a secondary vane 244 that is also configured to define triangular connecting fillet-like wall segment connected to primary vane 240 at its root and to the sidewall surface of impeller shaft 210.

Referring now to FIGS. 2B and 2C, impeller 200 has a distally extended impeller shaft and the impeller shaft sidewall carries first, second and third radially projecting, axially aligned impeller shaft sidewall segments, 272, 274 and 276. FIG. 2D illustrates two of the impeller's primary vanes 220, and 230, each connected with a secondary vane, and also illustrates two of the distally projecting impeller shaft sidewall's radially projecting, axially aligned impeller shaft sidewall segments 272, 274, which have a tapered wall thickness that narrows gradually toward the impeller shaft's distal end. Note the secondary vanes can have twisting similar to the primary vanes.

Each primary vane has a leading or convex edge and a trailing or concave edge, and the leading and trailing edges are each curved 59 degrees at the tip (as compared to a radial line). For purposes of characterizing the arcuate shape of the "curve" of the vanes, FIGS. 2A-2D can be considered as being scaled drawings. The leading edge curvature of the primary vane is 8.50 mm, with an initial radial section of 1 mm.

Viewed in cross section, each vane also has a 20 degree "twist", meaning that the leading or convex surface of each vane is angled rearwardly to be 20 degrees from vertical, where a "vertical" line is parallel to the impeller shaft's central axis. As best seen in FIGS. 2A and 2C, each impeller vane's convex leading surface is angled or twisted to define a curved surface which is parallel to that vane's concave or trailing surface. While the leading and trailing surfaces on each vane are angled by the selected twist angle (20 degrees) from vertical, the top and bottom surfaces are each substantially perpendicular planar surfaces, meaning that each vane's top surface is perpendicular to the impeller shaft's central axis, and each vane's bottom surface is substantially parallel to that vane's top surface. In the illustrated embodiments, each vane has a dimple or raised, rounded feature 290 with a height from the vane top or bottom surface that is selected to be slightly less than the 0.15 mm clearance desired between the vane's and the volute casing surfaces defining the pumping chamber.

Each primary vane's secondary vane defines an exposed sidewall segment that is inclined at approximately 34 deg to the impeller shaft's central axis and each is 3.8 mm high and can be twisted like the primary vanes. The overall swept diameter of the impeller is 21.75 mm and the width of each primary vane is 2.5 mm. The diametral clearance between the impeller vane's distal tips or ends and the volute's interior sidewall 310 is preferably approximately 1.25 mm. The total top-bottom clearance between the impeller and the interior surfaces of the pump chamber or casing is preferably about 0.3 mm, where that clearance is preferably divided substantially equally between the top and bottom such that there is about 0.15 mm clearance between the upper surface of the vanes and the casing bottom wall and about 0.15 mm clearance between the lower surface of the vanes and the volute's planar interior wall. In the embodiment illustrated in FIG. 3A, the total length of the impeller (along the axis of the shaft) is 30.75 mm.

FIG. 3A is perspective view, in elevation and partial cross section, for improved pump assembly 100 showing that a substantially cylindrical casing 400 has an electrical connector cap 410 on a first or top cylindrical end opposite the casing's bottom surface (as shown in FIG. 1C), which, along with volute 300 defines the pumping chamber containing the rotatably operable impeller 200. In the illustrative embodiment, casing 400 also contains a DC electric motor 500 which, when energized, delivers energy through a shaft which passes through shaft seal 520 and is affixed into a keyway or spline in impeller coupling aperture 262, to drive the impeller and pressurize fluid in the pumping chamber defined between volute 300 and the bottom surface of casing 400. During operation, motor 500 drives impeller 200 which spins within the pumping chamber, drawing fluid into the volute's inlet 320; past the secondary vanes, which impart some velocity and onto the primary, curved, twisted vanes, which impart more velocity to the fluid via the twisted and convex leading surfaces of the primary vanes 220, 230 and 240. That fluid velocity develops pressure within volute 300 as the fluid is pumped from inlet 320 and outwardly against the volute's interior sidewall 310, and the fluid is pumped toward and through the volute's outlet 350.

There are two other exemplary embodiments for the pump assembly of the present invention, each having a side inlet. In the side-inlet top-feed pump assembly embodiment shown in FIGS. 4A and 4B, impeller 1200 operatively similar to impeller 200 from the bottom-inlet configuration of FIG. 3A, but has a much shorter central shaft 1210 and has the motor shaft slot 1262 on the opposite side.

Figure 4A:
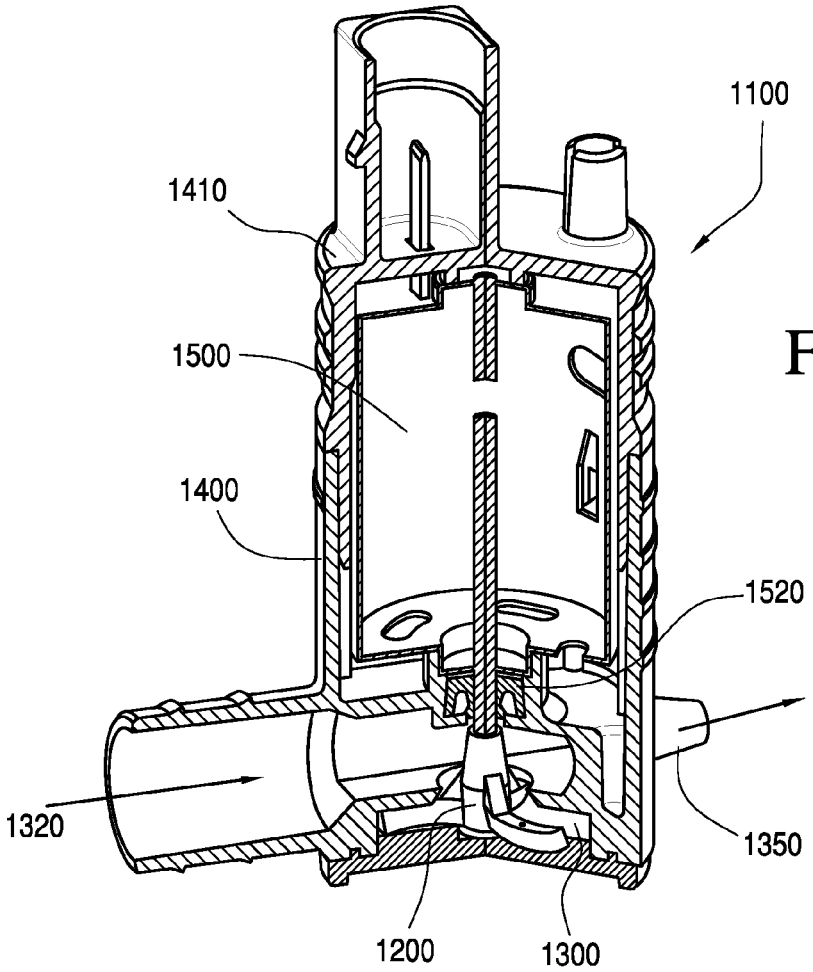
FIG. 4A is perspective view, in elevation and partial cross section, for a side inlet top feed embodiment of the improved pump assembly of the present invention.
Figure 4B:
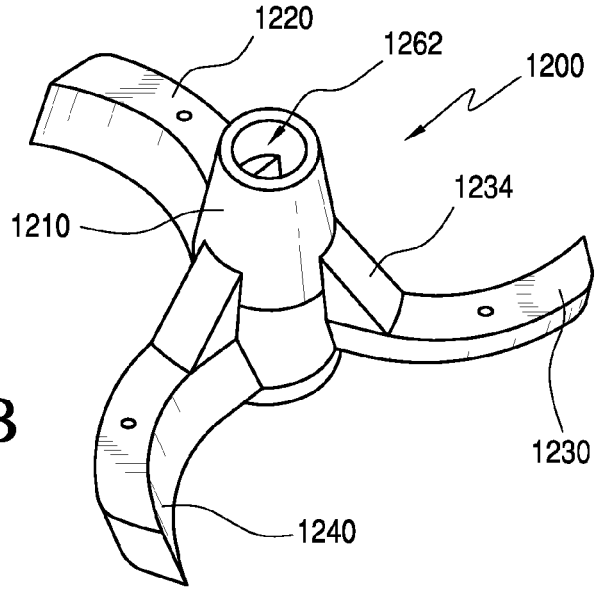
FIG. 4B is a perspective view of the impeller configured for use with the pump assembly embodiment of FIG. 4A.

FIG. 4A is perspective view, in elevation and partial cross section, for another improved pump assembly 1100 showing that a substantially cylindrical casing 1400 has an electrical connector cap 1410 on a first or top cylindrical end opposite the casing's bottom surface, which includes volute 1300 and defines the pumping chamber containing the rotatably operable impeller 1200. In the illustrative embodiment, casing 1400 also contains a DC electric motor 1500 which, when energized, delivers energy through a shaft which passes through shaft seal 1520 and is affixed into a keyway or spline in impeller coupling aperture 1262, to drive impeller 1200 and pressurize fluid in the pumping chamber defined between volute 1300 and a disc-shaped member sealed and affixed to the bottom surface of casing 1400. During operation, motor 1500 drives impeller 1200 which spins within the pumping chamber, drawing fluid into the volute's inlet 1320, past the secondary vanes (1224, 1234 and 1244 (see FIG. 4B)), which impart some velocity and then onto the primary, curved, twisted vanes, which impart more velocity to the fluid via the twisted and convex leading surfaces of the primary vanes 1220, 1230 and 1240. That fluid velocity develops pressure within volute 1300 as the fluid is pumped from inlet 1320 and outwardly against the volute's interior sidewall, and the fluid is pumped toward and through the volute's outlet 1350. Volute 1300 includes a spiral casing which is operatively the same as volute 300 illustrated in FIG. 1A, but it is configured to work with the side inlet 1320.

Figure 5A:
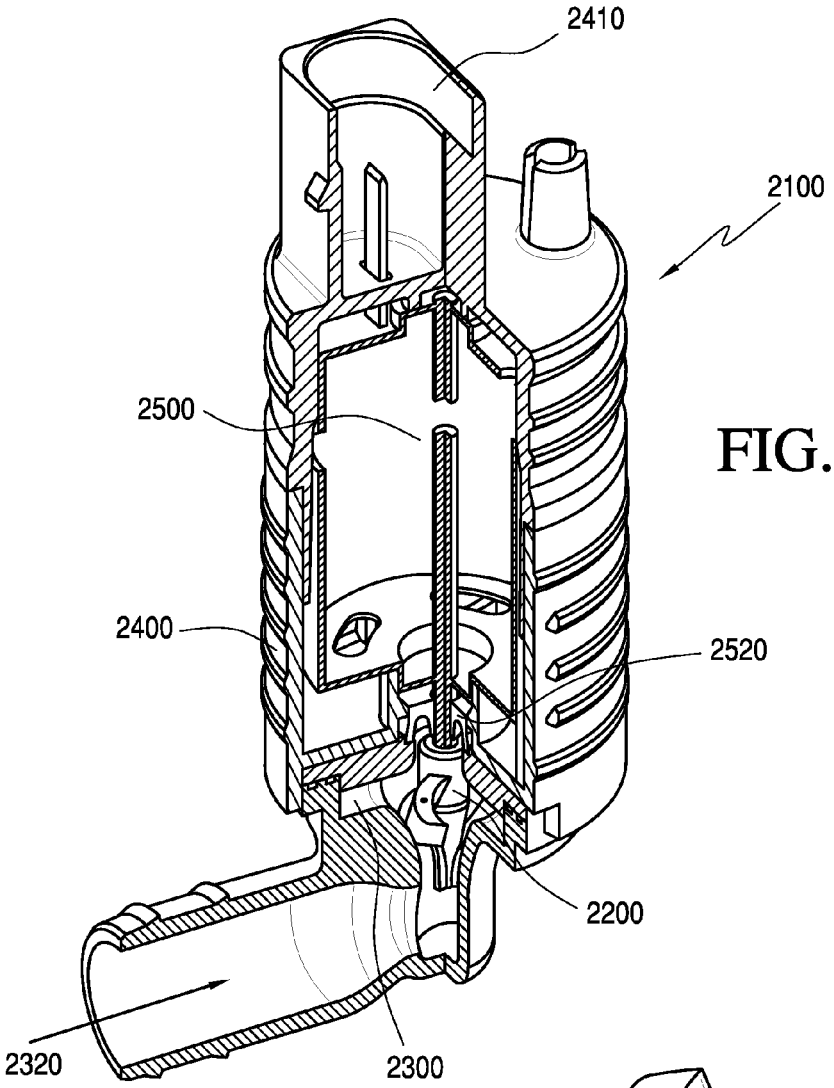
FIG. 5A is perspective view, in elevation and partial cross section, for a side inlet bottom feed embodiment of the improved pump assembly of the present invention.
Figure 5B:
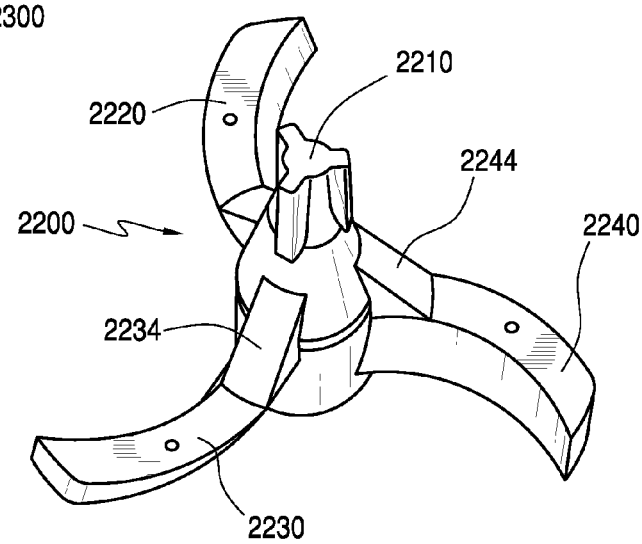
FIG. 5B is a perspective view of the impeller configured for use with the pump assembly embodiment of FIG. 5A.

The third illustrative embodiment shows a side-inlet bottom-feed pump assembly 2100, wherein impeller 2200 is similar to the bottom-inlet configuration, but has a much shorter central shaft length. The total length of impeller 2200 (shown in FIG. 5B) and its shaft 2210 is 13.5 mm. This length relative to the straight portion of the feed of inlet 2320 is important for performance. The casing geometry is otherwise similar to the bottom-inlet configuration of FIG. 3A. FIG. 5A is perspective view, in elevation and partial cross section, for improved pump assembly 2100 showing that a substantially cylindrical casing 2400 has an electrical connector cap 2410 on a first or top cylindrical end opposite the casing's bottom surface, which, along with volute 2300 defines the pumping chamber containing the rotatably operable impeller 2200. In the illustrative embodiment, casing 2400 also contains a DC electric motor 2500 which, when energized, delivers energy through a shaft which passes through shaft seal 2520 and is affixed into a keyway or spline in an impeller coupling aperture, to drive impeller 2200 and pressurize fluid in the pumping chamber defined between volute 2300 and the bottom surface of casing 2400. During operation, motor 2500 drives impeller 2200 which spins within the pumping chamber, drawing fluid into the volute's inlet 2320, past the secondary vanes (2224, 2234 and 2244), which impart some velocity and onto the primary, curved, twisted vanes, which impart more velocity to the fluid via the twisted and convex leading surfaces of the primary vanes 2220, 2230 and 2240. That fluid velocity develops pressure within volute 2300 as the fluid is pumped from inlet 2320 and outwardly against the volute's interior sidewall, and the fluid is pumped toward and through the volute's outlet (not shown). Volute 2300 includes a spiral casing which is operatively the same as volute 300 illustrated in FIG. 1A, but it is configured to work with the side inlet 2320.

Generally speaking, the pump assembly of the present invention has a few characteristics that are common to all of the exemplary configurations. The enhanced pump assembly includes an impeller and volute casing designed to provide high operating pressures ("P") and flow rates ("Q") with low energy usage. The impeller has a central shaft carrying radially projecting curved primary vanes, and each primary vane also has a "twist" to provide an angled leading convex surface. Secondary impeller vanes define triangular connecting fillet-like wall segments connecting each primary vane to the impeller shaft and can be twisted like the primary vanes. The casing of the pump has a slight spiral deviation so that the pump chamber's radial sidewall flares away from the swept area of the impeller's vanes to define a fluid outlet that contributes to higher P-Q performance, especially when pumping colder fluids. The casing has a circular profile for approx. 260 deg (providing constant clearance with impeller) and then, approaching the outlet, transitions to a gradually increasing clearance all the way to the exit, where the casing radius is approximately 1.6 times the radius of the casing sidewall's circular profile.

Broadly speaking, the pump assembly (e.g., 100, 1100 or 2100) is configured to pressurize a selected fluid and comprises, a volute defining a fluid inlet for receiving the fluid; a casing configured with the volute to define a pumping chamber that is in fluid communication with said inlet; a rotatably supported impeller configured operate within the pumping chamber; a volute fliuid passage communicating the pump chamber and the fluid outlet for discharging fluid medium under pressure during a rotation of the impeller; wherein said impeller has a central axis of rotation and a central shaft aligned along the impeller's axis of rotation and carrying a plurality (e.g., three) radially projecting and curved primary vanes; wherein each primary vane has a twist in the radial direction so that each vane has provides an angled, concave leading surface; wherein the impeller also has a plurality of radially projecting secondary vanes affixed to said central shaft such that each secondary vane is also aligned with and affixed to said radially projecting curved primary vanes; wherein said volute has an interior sidewall (e.g., 310) that has a constant internal first radius over a first sidewall portion and transitions (e.g., at 312) to a second sidewall portion of increasing radius; wherein the second sidewall portion defines a first end at a sidewall transition point (e.g., 312) which is tangent to the constant radius sidewall segment, and defines a second end which is tangent to the volute's fluid outlet (e.g., 350) and has a second radius that is greater than the first radius (e.g., as shown in FIGS. 1A and 1B.

Figure 6A:
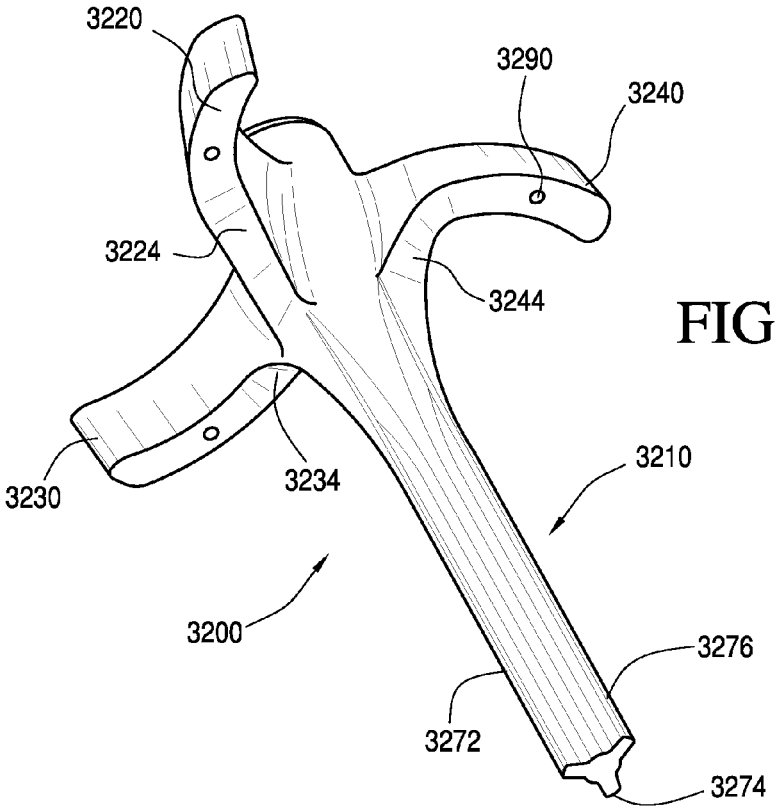
FIG. 6A is perspective view of another impeller and illustrates the twisted secondary vanes flared contiguously into the impeller shaft sidewall's first, second and third radially projecting, axially aligned impeller shaft sidewall segments, in accordance with the present invention.
Figure 6C:
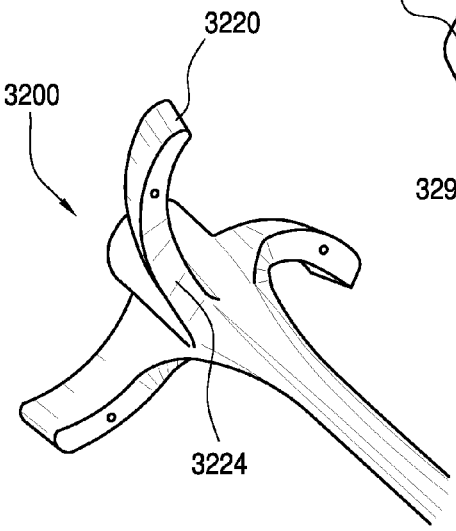
FIG. 6C is view of the impeller of FIGS. 6A and 6B and illustrates the distal end of the impeller shaft including the distal ends of the impeller shaft's first, second and third radially projecting, axially aligned impeller shaft sidewall segments, in accordance with the present invention.
Figure 6B:
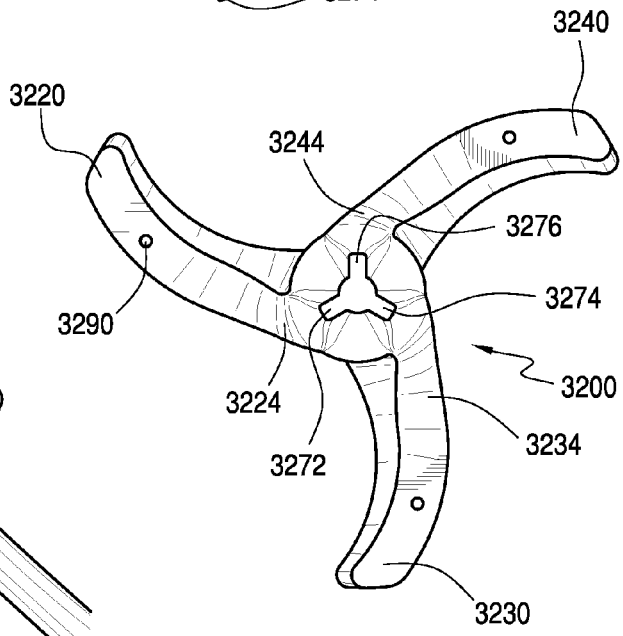
FIG. 6B is another perspective view of the impeller of FIG. 6A, in accordance with the present invention.

Optionally, the impeller's secondary impeller vanes are each twisted so that the leading surface of the secondary vane is angled or twisted to match the primary vane's leading surface and define a contiguous surface across both the primary vane and its secondary vane (e.g., as shown in FIGS. 6A-6C).

FIGS. 6A-6C illustrate another embodiment of an impeller 3200 adapted for use in a pump assembly (e.g., 100 of FIG. 3A). Impeller 3200 has an upper or proximal end with a drive motor shaft receiving coupling aperture (not shown). Impeller 3200 carries a first transversely projecting curved, twisted primary vane 3220, which is contiguous with a secondary vane 3224 and the sidewall segment 3272 on impeller shaft 3210, such that the secondary vane is "twisted." Impeller 3200 carries a second transversely projecting curved, twisted primary vane 3230, and second primary vane 3230 is radially spaced 120 degrees from first vane 3220. Second primary vane is contiguous with a secondary vane 3234 and with sidewall segment 3274 on impeller shaft 3210. Impeller 3200 also carries a third transversely projecting curved, twisted primary vane 3240, and third primary vane 3230 is radially spaced 120 degrees from both first vane 3220 and second vane 3230, so that three radially equi-angled vanes are carried by shaft 3210. The third primary vane is contiguous with a secondary vane 3244 that is also contiguous with sidewall segment 3276 on impeller shaft 210. Impeller 3200 has a distally extended impeller shaft and the impeller shaft sidewall carries the first, second and third radially projecting, axially aligned impeller shaft sidewall segments, 3272, 3274 and 3276 which taper in wall thickness to narrow gradually toward the impeller shaft's distal end. Each primary vane has a leading or convex edge and a trailing or concave edge, and the leading and trailing edges are each curved 59 degrees at the tip (as compared to a radial line). For purposes of characterizing the arcuate shape of the "curve" of the vanes, FIGS. 6A-6C can be considered as being scaled drawings. Viewed in cross section, each vane also has a 20 degree "twist", meaning that the leading or convex surface of each vane is angled rearwardly to be 20 degrees from vertical, where a "vertical" line is parallel to the impeller shaft's central axis. As best seen in FIG. 6A, each impeller vane's convex leading surface is angled or twisted to define a curved surface which is parallel to that vane's concave or trailing surface. While the leading and trailing surfaces on each vane are angled by the selected twist angle (20 degrees) from vertical, the top and bottom surfaces are each substantially perpendicular planar surfaces, meaning that each vane's top surface is perpendicular to the impeller shaft's central axis, and each vane's bottom surface is substantially parallel to that vane's top surface. In the illustrated embodiments, each vane has a dimple or raised, rounded feature 3290 with a height from the vane top or bottom surface that is selected to be slightly less than the 0.15 mm clearance desired between the vane and the volute casing surfaces defining the pumping chamber.

The components described above (apart from the pump motor and shaft) are preferably made of molded plastics (e.g., synthetic polymers such as Nylon™ or another polyamide) but, for selected applications might be made of plastic, steel, bronze, brass or aluminum.

It is evident that various modifications could be made to the present invention without departing from the basic teachings thereof, and that the descriptive text of these embodiments is not intended to define the scope of the present invention, since that is contained in the claims. Therefore, when the text of this patent application discloses particular components and configurations and arrangements of these components, this description is not intended to limit corresponding recitations of these components in the claims to that particular configuration or component.

Also, the various relationships of the design parameters of the embodiments as disclosed in the previous text are characteristic of the apparatus being designed for one application, and yet could be used in a variety of applications. Nevertheless, the design requirements may be rather different for different applications, such as operating in different environments, the need to have different dimensional requirements due to the configuration or characteristics of the structure or other device with which it is to be associated, etc.

Thus, while some of these relationships may be applicable to these somewhat modified designs, it could be that others are not. Therefore, providing this information of these various design parameters is not necessarily to limit the scope of the claims in covering apparatus which may be totally outside of some of those relationships, and the scope of the claims is not intended to be limited to incorporating any or all of these design requirements, without departing from the basic teachings of the present invention.

Having described preferred embodiments of a new and improved apparatus and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

We claim:

1. A pump assembly configured to pressurize a fluid comprising:

a volute defining a fluid inlet for receiving the fluid;

a casing configured with the volute to define a pumping chamber that is in fluid communication with said inlet;

a rotatably supported impeller configured operate within said pumping chamber, a volute fluid passage communicating the pump chamber and the fluid outlet for discharging fluid medium under pressure during a rotation of the impeller;

wherein said impeller has a central axis of rotation and a central shaft aligned along said impeller's axis of rotation and carrying a plurality of radially projecting curved primary vanes;

wherein each primary vane has a twist in the radial direction so that each vane has provides an angled, convex leading surface;

wherein said impeller also has a plurality of radially projecting secondary vanes affixed to said central shaft such that each secondary vane is also aligned with and affixed to said radially projecting curved primary vanes;

wherein said volute has an exterior sidewall that has a constant internal first radius over a first sidewall portion and transitions to a second sidewall portion of increasing radius;

wherein said second sidewall portion defines a first end at a sidewall transition point which is tangent to said constant radius sidewall segment, and defines a second end which is tangent to said volute's fluid outlet and has a second radius that is greater than said first radius.

2. The pump assembly of claim 1, wherein said impeller's secondary impeller vanes are each configured to define a triangular connecting fillet-like wall segment connected to a primary vane and to the impeller shaft.

3. The pump assembly of claim 1, wherein said impeller's secondary impeller vanes are each twisted so that the leading surface of the secondary vane is angled or twisted to match the primary vane's leading surface and define a contiguous surface across both the primary vane and it's secondary vane.

4. The pump assembly of claim 1, wherein said pump volute's sidewall defines a spiral deviation wherein the pump chamber's radial sidewall flares away from the swept area of the impeller's vanes and defines a fluid outlet that contributes to higher P-Q performance, especially when pumping colder fluids.

5. The pump assembly of claim 1, wherein said volute sidewall has a constant internal diameter or circular profile for approx. 260 degrees, providing constant clearance with impeller and then, approaching the outlet, transitions to a gradually increasing clearance all the way to the outlet, where the casing radius is 1.6 times the radius of the casing sidewall's circular profile.

6. The pump assembly of claim 1, wherein said volute's inlet is axially aligned with said impeller's central axis of rotation in a bottom inlet configuration.

7. The pump assembly of claim 1, wherein said volute's inlet is axially aligned with said impeller's central axis of rotation in a side inlet, top feed configuration.

8. The pump assembly of claim 1, wherein said volute's inlet comprises a lumen with a transition from lateral flow to vertical flow, where the vertical flow is axially aligned with said impeller's central axis of rotation in a side inlet, bottom feed configuration.

9. The pump assembly of claim 1, wherein said impeller carries three primary impellers spaced at 120 degree intervals around the impeller shaft's central axis.

10. The pump assembly of claim 9, wherein said impeller carries three secondary impeller vanes, and wherein each of the secondary impellers are axially aligned with a single corresponding primary impeller.

11. The pump assembly of claim 1, wherein said impeller's primary vanes are each curved in an arc to provide a convex leading surface that terminates in a distal vane tip.

12. The pump assembly of claim 11, wherein said impeller's primary vanes each have a substantially planar upper surface which is parallel to and opposite a substantially planar lower surface and perpendicular to said impeller's central axis of rotation.

13. The pump assembly of claim 12, wherein said impeller primary vane upper surface carries a raised dimple or protuberance having a height selected to maintain a selected clearance between said impeller vane and the interior of the pumping chamber.

14. The pump assembly of claim 12, wherein said impeller primary vane lower surface carries a raised dimple or protuberance having a height selected to maintain a selected clearance between said impeller vane and the interior of the pumping chamber.

15. The pump assembly of claim 1, further comprising an electric motor configured to drive a shaft having a distal end, and wherein said impeller has an aperture or coupling configured to receive and be driven by said motor shaft's distal end.

16. An impeller adapted for use in a centrifugal pump assembly having a volute, an inlet and an outlet, comprising:

a central shaft and a central axis of rotation, wherein said shaft is aligned along said impeller's axis of rotation;

a plurality of radially projecting curved primary vanes carried by said central shaft;

wherein each primary vane has a twist in the radial direction so that each vane has provides an angled, convex leading surface;

a plurality of radially projecting secondary vanes affixed to said central shaft such that each secondary vane is also aligned with and affixed to said radially projecting curved primary vanes.

17. The impeller of claim 16, wherein said impeller's secondary impeller vanes are each twisted so that the leading surface of the secondary vane is angled or twisted to match the primary vane's leading surface and define a contiguous surface across both the primary vane and it's secondary vane.

* * * * *

UNITED STATES PATENT AND TRADEMARK OFFICE

CERTIFICATE OF CORRECTION

PATENT NO. : 8,348,606 B2
APPLICATION NO. : 12/481357
DATED : January 8, 2013
INVENTOR(S) : Shridhar Gopalan, Alan Romack and Chunling Zhao It is certified that error appears in the above-identified patent and that said Letters Patent is hereby corrected as shown below:

In the Claims:

In claim 1, column 12 line 2 reads:

"tion so that each vane has provides an angled, convex"

it should read:

"tion so that each vane provides an angled, convex"

In claim 16, column 14 line 4 reads:

"tion so that each vane has provides an angled, convex"

it should read:

"tion so that each vane provides an angled, convex"

Signed and Sealed this
Fourteenth Day of May, 2013

Teresa Stanek Rea
*Acting Director of the United States Patent and Trademark Office*